United States Patent [19]

Knäbel

[11] 4,048,840

[45] Sept. 20, 1977

[54] APPARATUS FOR PRODUCING AN INSTANTANEOUS PRESSURE ON A WORKPIECE

[76] Inventor: Korst Knäbel, Uedesheimer Strasse 5, 4000 Dusseldorf, Germany

[21] Appl. No.: 753,483

[22] Filed: Dec. 22, 1976

[30] Foreign Application Priority Data

Jan. 13, 1976 Germany ..... 2600948

[51] Int. Cl.[2] ..... B21J 9/12

[52] U.S. Cl. ..... 72/437; 72/407; 72/453.1

[58] Field of Search ..... 72/437, 436, 407, 453.18, 72/453.1, 453.02, 453.7, 453

[56] References Cited

U.S. PATENT DOCUMENTS

| | | | |
|---|---|---|---|
| 3,108,503 | 10/1963 | Murek | 72/453.1 |
| 3,707,866 | 1/1973 | Braver | 72/407 |
| 3,756,065 | 9/1973 | Kononenko | 72/453.1 |

*Primary Examiner*—C.W. Lanham
*Assistant Examiner*—Gene P. Crosby
*Attorney, Agent, or Firm*—Michael J. Striker

[57] ABSTRACT

Apparatus for producing an instantaneous pressure on a workpiece includes a working piston, one side of which is impinged by gas under pressure tending to move the working piston from a starting position in a direction towards the workpiece, whereas the other side of the working piston is over a control valve impingable by a pressure fluid, preferably a hydraulic fluid, whereby the working piston is returnable to the starting position. A control piston is movable from a first position extending into a space communicating with the space into which the pressure fluid is fed to a second position moved out of the space and the volume of the control piston is such so as to produce during its movement from said first to said second position an instantaneous relief of the pressure of the pressure fluid acting on the other side of the working piston, whereby a corresponding instantaneous pressure is produced on the workpiece by a piston rod projecting from the other side of the working piston in engagement with the workpiece. The apparatus is used for forging, deep drawing, coining, etc. of a workpiece.

20 Claims, 6 Drawing Figures

$D_2 > D_1$
29
30
6
4
$D_1$
$D_2$
1
2
31
32
33

20
18
19
6
8
15
14
54
9
11
10
4
30
16
35
29
2
26
3
1
31
27
17
28
25
34
56

APPARATUS FOR PRODUCING AN INSTANTANEOUS PRESSURE ON A WORKPIECE

BACKGROUND OF THE INVENTION

The present invention relates to an apparatus for producing an instantaneous pressure onto a workpiece with a working piston impingable by gas under pressure and a control arrangement constructed to let the gas pressure in a controlled manner to act on the working piston.

A known apparatus of this kind comprises a cylinder which is separated into two chambers by a wall provided with a bore therethrough. A working piston is axially guided in a sealed manner in one of the chambers, whereas a control piston of a control device is arranged in the other chamber, and held by hydraulic pressure in a position closing the bore in the separating wall. The chamber separated from the working piston is impinged by a gas under high pressure. When the necessary working pressure is obtained in the other chamber, the hydraulic pressure acting on the control piston is released so that the latter is moved away from the separating wall and opens thereby the bore therethrough to provide communication between the two chambers. The gas under high pressure expands through the bore in the separating wall and accelerates the working piston to high speed.

A decisive disadvantage of this known apparatus is that the working piston has first to be accelerated to obtain the deforming energy and to impinge with high speed on the workpiece. This requires that the apparatus must be built correspondingly long and heavy. A further disadvantage of this known apparatus is that the highly compressed gas has to pass through the bore in the separating wall in order to act on the working piston, whereby a considerable throttling action will occur which considerably increases the pressure build-up in the working cylinder. In addition, since the working piston, respectively the piston rod thereof, is initially spaced from the workpiece and moves at high speed in engagement therewith, the operation of this known apparatus leads to considerable vibrations thereof and undesirable development of noise.

SUMMARY OF THE INVENTION

It is an object of the present invention to provide an apparatus of the aforementioned kind which avoids the disadvantages of such apparatus known in the art.

It is a further object of the present invention to provide an apparatus of the aforementioned kind in which an instantaneous pressure on a workpiece is obtained at the moment an instantaneous pressure is exerted on the working piston of the apparatus.

It is an additional object of the present invention to provide an apparatus of the aforementioned kind which is composed of relatively few and simple parts so that the apparatus may be built at reasonable cost and stand up properly under extended use.

With these and other objects in view, which will become apparent as the description proceeds, the apparatus according to the present invention for producing an instantaneous pressure on a workpiece mainly comprises a main cylinder having a pair of opposite ends, a working piston axially movable in the main cylinder between a working stroke and a return stroke and dividing the latter into two compartments, a piston rod projecting through one of the compartments and one of the ends of the main cylinder to the outside of the latter and engaging with a free end thereof the workpiece, a gas under pressure in the other compartment and acting on one side of the working piston tending thereby to move said piston along the working stroke, means including a control valve for feeding a pressure fluid into the one compartment to act on the other side of the piston, means forming an enclosed space communicating with the one compartment so as to be also filled with the pressure fluid, a control piston movable from a first position extending into the aforementioned space to a second position withdrawn out of the space, with one end face of the control piston in the first position free of pressure, and pressure means acting on the other face of the control piston for biasing the same to the first position, and the control piston having a volume to produce during its movement from the first to the second position an instantaneous relief of the pressure of the pressure fluid acting on the other side of the working piston so that the gas pressure acting on the one side of the piston will produce a corresponding instantaneous pressure by the piston rod on the workpiece, and means for moving the control piston from the first to the second position.

One advantage of the present invention is the instantaneous production of pressure on the workpiece as soon as the control piston moves from its first to its second position, since the cross-section of the control piston may be kept relatively great with regard to the cross-section of the working piston.

Due to the instantaneous application of pressure on the workpiece, a high efficiency of the apparatus is derived and a high output can be obtained. The apparatus according to the present invention is controlled by elements of simple construction which will assure that the apparatus will stand up properly under extended use. Furthermore, the danger of accidents, as well as the development of undesired noise is considerably reduced with the appparatus according to the present invention as compared with similar apparatus known in the art.

The apparatus according to the present invention may for instance be used for forging, swaging, extrusion, coining, deep drawing, shearing and punching. In addition it may also be used for compacting of pulverulent ceramics or powder metals. Thereby, the apparatus according to the present invention may be used per se, as well as in connection with hydraulic presses or in connection with a counterpunch driven by a crank drive.

In a preferred arrangement the pressure medium acting on the working piston in a direction counter to its working stroke is a hydraulic fluid. This permits a high operating frequency, for instance a plurality of instantaneous very short pressure applications onto the workpiece.

The control piston is preferably guided in a control cylinder, movable between the positions thereof, to extend in the first position with one end into the aforementioned space to abut against a sealing face partly defining this space and the end face abutting against the sealing space may be relieved of pressure or impinged by a pressure fluid to move the control piston between the positions thereof.

In a further advantageous form of construction according to the present invention, the control piston is in form of an annular piston concentrically arranged with respect to the working piston. This will result in a compact space-saving construction.

In such a construction the diameter of the control piston may be advantageously greater than that of the working piston, whereby one end of the control piston may abut in its first position against an abutment formed in the main cylinder.

The means for moving the control piston from the first to the second position may comprise an auxiliary cylinder which communicates at one end with the gas-filled compartment of the main cylinder and a small diameter, auxiliary piston reciprocably guided in the auxiliary cylinder is connected to one end of the control piston for moving the latter from the first to the second position upon increase of the gas pressure in the other compartment. In this construction, the means for increasing the gas pressure in the other compartment may comprise means for moving the main cylinder toward the workpiece, while the free end of the piston rod engages the workpiece, and the means for moving the main cylinder may comprise a piston of a hydraulic press.

According to a further characteristic of the present invention, the arrangement may also include a control valve movable between an active position connecting a source of pressure fluid with the one compartment and an inactive position preventing flow of pressure fluid into the one compartment. The control valve preferably comprises an actuating piston for moving the control valve to the inactive position when impinged by pressure fluid to thereby move the control piston from the first to the second position.

According to a further embodiment according to the present invention, the means for moving the control piston from the first to the second position may comprise an auxiliary valve movable by an impulse between a first position connecting passage means leading to the one end face of the control piston to atmospheric pressure and a second position connecting the passage means to a source of pressure fluid.

The free end of the piston rod may constitute a forging or pressure tool but on the other hand, the free end portion of the piston rod may also form part of an extrusion press.

If, as mentioned above, the arrangement includes an auxiliary valve movable by an impulse between the positions thereof, the arrangement may also include a counter-punch arranged spaced from the free end of the piston rod coaxially therewith, with the workpiece located between the free end of the piston rod and the corresponding end of the counter-punch, and a crank drive for moving the punch toward the free end of the piston rod, in which the impulse is imparted to the auxiliary valve when the crank drive reaches the region of its upper dead-center position. According to a further feature of the invention, the piston rod may also pass axially movable and in a sealed manner through the working piston into the gas-filled compartment, to be subjected at one end thereof, opposite the free end engaging the workpiece, to the gas pressure in the other compartment, while the working piston abuts during its working stroke against abutment means provided on the piston rod.

The piston rod may also be elongated in such a manner so as to extend in a cylindrical space coaxially extending from the other compartment and pressure fluid may be fed into the cylindrical space for moving the piston rod relative to the working piston.

In a further advantageous embodiment according to the present invention, an additional piston is arranged in the other compartment of the main cylinder, spaced from the one side of the working piston and in this construction only the space in the other compartment between the additional piston and the working piston is filled with a gas under pressure. In this construction the means for moving the control piston from the first to the second position preferably comprise an auxiliary cylinder and an auxiliary small diameter piston connected to the control piston and means for feeding pressure fluid into the auxiliary cylinder and into the space of the other compartment between the additional piston and the end of the main cylinder opposite the end through which the piston rod extends. Such an arrangement may for instance be used in order to exert a plurality of instantaneous quickly following pressures onto the workpiece. The additional piston and the working piston can thereby intermittently be moved in working direction, while the piston rod connected to the working piston remains in contact with the workpiece. After a predetermined deformation of the workpiece, the succession of intermittent instantaneous pressure applications may be interrupted, and the additional piston and the working piston, with the gas-filled space between the same, may be again returned in a direction opposite to the working direction to a starting position. This may be accomplished by discharging pressure fluid from the space between the closed end of the main cylinder and the additional piston, for instance through a multiple position valve, so that the pressure fluid, for instance, a hydraulic fluid, may flow to a tank or the like, whereas hydraulic fluid is at the same time fed into the space between the working piston and the other end of the main cylinder, so that the working piston and the additional piston with the compressed gas therebetween are moved back to their starting position. This sequence of operation may then be repeated, but of course it is also possible to carry out a single instantaneous pressure application with this arrangement.

The means for moving the control piston from the first to the second position may also comprise an auxiliary cylinder, an auxiliary piston reciprocably guided in the auxiliary cylinder and engaging the one end of the control piston for moving the latter from the first to the second position when the fluid pressure in the one compartment of the main cylinder reaches a predetermined pressure. In this construction the main cylinder may also be movable in axial direction towards the workpiece by arranging a press cylinder coaxial with the main cylinder and a piston reciprocably guided in the press cylinder and projecting with one end thereof through an open end of the press cylinder and into engagement with the other end of the main cylinder so that by feeding of pressure fluid into the space between the closed end of the press cylinder and the other end of the piston, the main cylinder will be moved in axial direction toward the workpiece.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
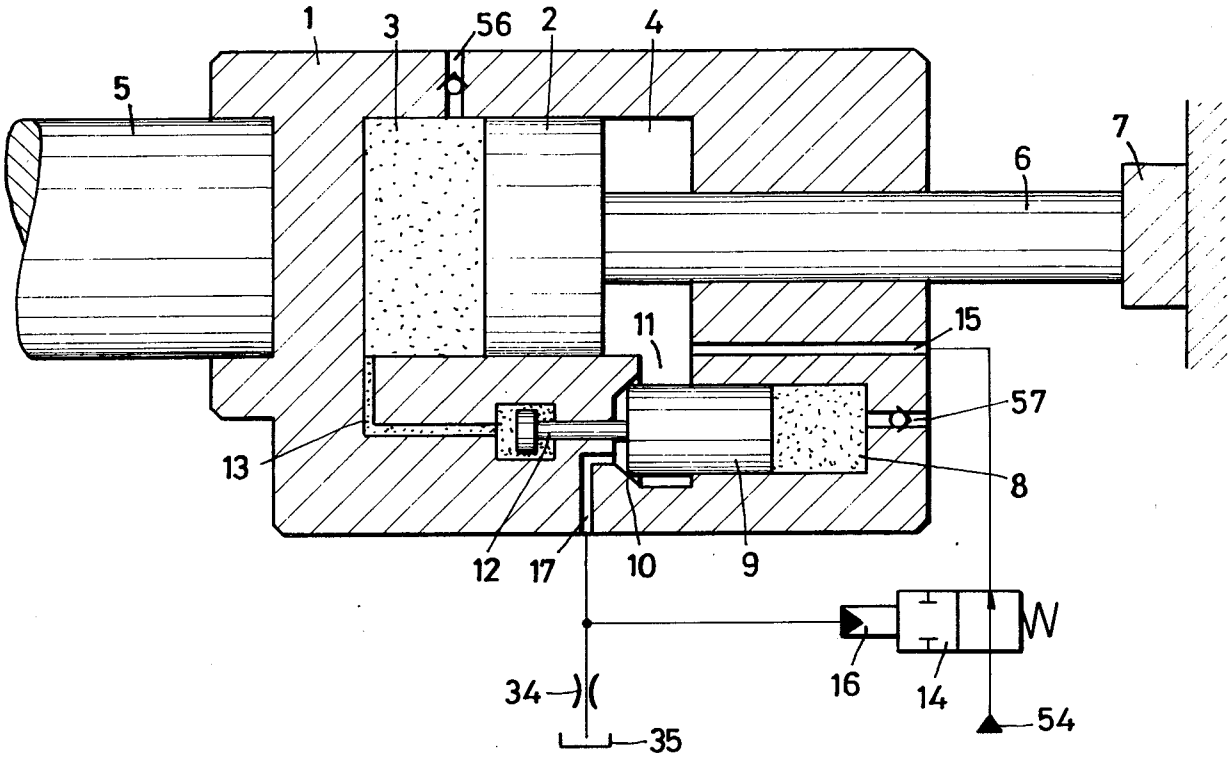
FIG. 1 is a longitudinal cross-section through a first embodiment according to the present invention, in which the main cylinder is axially movable towards the workpiece.

Referring now to the drawing, and more specifically to FIG. 1 of the same, it will be seen that the embodiment according to the present invention illustrated therein may comprise a main cylinder 1 in which a working piston 2 is closely guided reciprocable, which divides the interior of the main cylinder 1 into two compartments 3 and 4. The compartment 3 is filled with a gas under pressure, whereas the compartment 4 may be filled with a pressure fluid, which may likewise be a gas under high pressure, but preferably be a hydraulic fluid.

In this embodiment the main cylinder 1 is axially movable by means of the piston 5 of a hydraulic press, not illustrated in FIG. 1, and engaging one end of the cylinder 1, whereas a piston rod 6, fixedly connected to the working piston 2, projects fluid tightly guided through the other end of the main cylinder 1 into engagement with a schematically illustrated, stationarily arranged workpiece 7. The end of the piston rod 6 may be formed as a forging, respectively, as a pressure tool.

A control piston 9 is, fluid-tightly guided, reciprocable in axial direction in a control cylinder 8, which is filled with a gas of relatively small pressure, or in which a compression spring may be arranged, to bias the control piston 9 to the position shown in FIG. 1 in which a front end of the control piston 9 is pressed against a sealing face 10, which partly defines a space 11 in communication with the compartment 4, so that the pressure medium in this compartment cannot exert any pressure on the front end of the control piston 9. This front end of the control piston 9 is engaged by the piston rod of a small diameter auxiliary piston 12, arranged in an auxiliary cylinder which communicates through a channel 13 with the compartment 3 filled with a gas under high pressure, so that this gas acts on the auxiliary piston 12. The compartment 4 is filled with fluid under pressure through a control valve 14 and a passage 15 through the main cylinder 1, whereby the pressure of the fluid fed into the compartment 4 is so high that the working piston 2 is moved towards the left, as viewed in FIG. 1 against the gas pressure maintained in the compartment 3.

The control valve 14 comprises an actuating piston 16, which is connected by a passage 17 to the space 11, when the control piston moves away from the sealing face 10. This will occur when the gas pressure in the compartment 3 will be great enough to move the auxiliary piston 12 and therewith the control piston 9 against the pressure in the control cylinder 8. In the embodiment shown in FIG. 1 this will occur when the main cylinder 1 is moved by the piston 5 towards the right, as viewed in FIG. 1, while the free end of the piston rod 6 engages the workpiece, whereby the working piston 2 moves towards the left relative to the main cylinder 1, as viewed in FIG. 1, to thereby further compress the gas in the compartment 3. At the moment the front end of the control piston 9 leaves the sealing face 10, the pressure of the fluid medium in the compartment 4 will act on the front end of the control piston 9, to move the latter instantaneously towards the right, as viewed in FIG. 1, so that an instantaneous lowering of the fluid pressure will occur in the compartment 4. At the same moment a connection between the compartment 4 and the passage 17 will be produced so that pressure fluid may flow out from the compartment 4 through the passage 17 and pass through a throttle 34 into a tank 35. The throttle 34 will produce a pressure head upstream of the throttle which is transmitted to the actuating piston 16 of the control valve 14, to move the latter from the position shown in FIG. 1 towards the right, as viewed in FIG. 1, whereby feeding of pressure fluid, from a source of pressure fluid 54, through the passage 15 into the compartment 4 of the main cylinder 1 is interrupted. Due to the sudden pressure relief in the compartment 4, produced by the sudden movement of the control piston towards the right, as viewed in FIG. 1, the gas pressure in the compartment 3 will instantaneously act on the working piston 2, to produce through the piston rod 6 a corresponding instantaneous pressure on the workpiece 7. This instantaneous action is produced due to the relatively large volume of the control piston, which is practically instantaneously displaced out of the space 11. During and after the working action of the working piston 2, pressure medium flows through the passage 17 and the throttle 34 to the tank 35. This connection will again be interrupted as soon as the force acting in the control cylinder 8 against the control piston 9 moves the latter again back to its starting position shown in FIG. 1.

Figure 4:
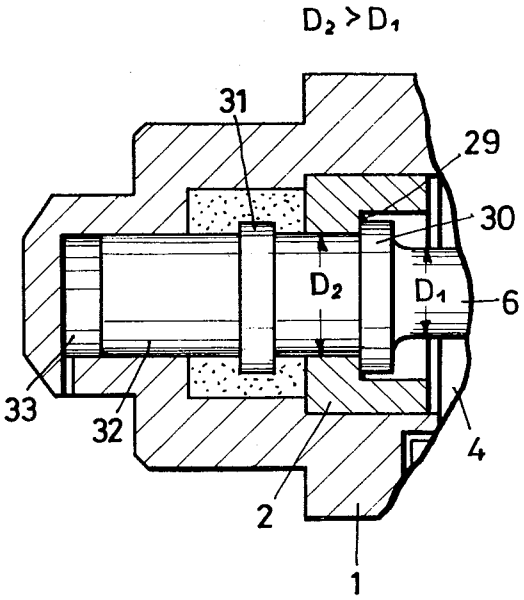
FIG. 4 is a partial cross-section through a fourth embodiment, in which the piston rod forms an ejector.

Instead of increasing the gas pressure in the compartment 3 by moving the working cylinder 1 by the piston 5 towards the right, as viewed in FIG. 4, the gas pressure in the compartment 3 may also be increased by feeding additional gas under high pressure thereinto.

Figure 2:
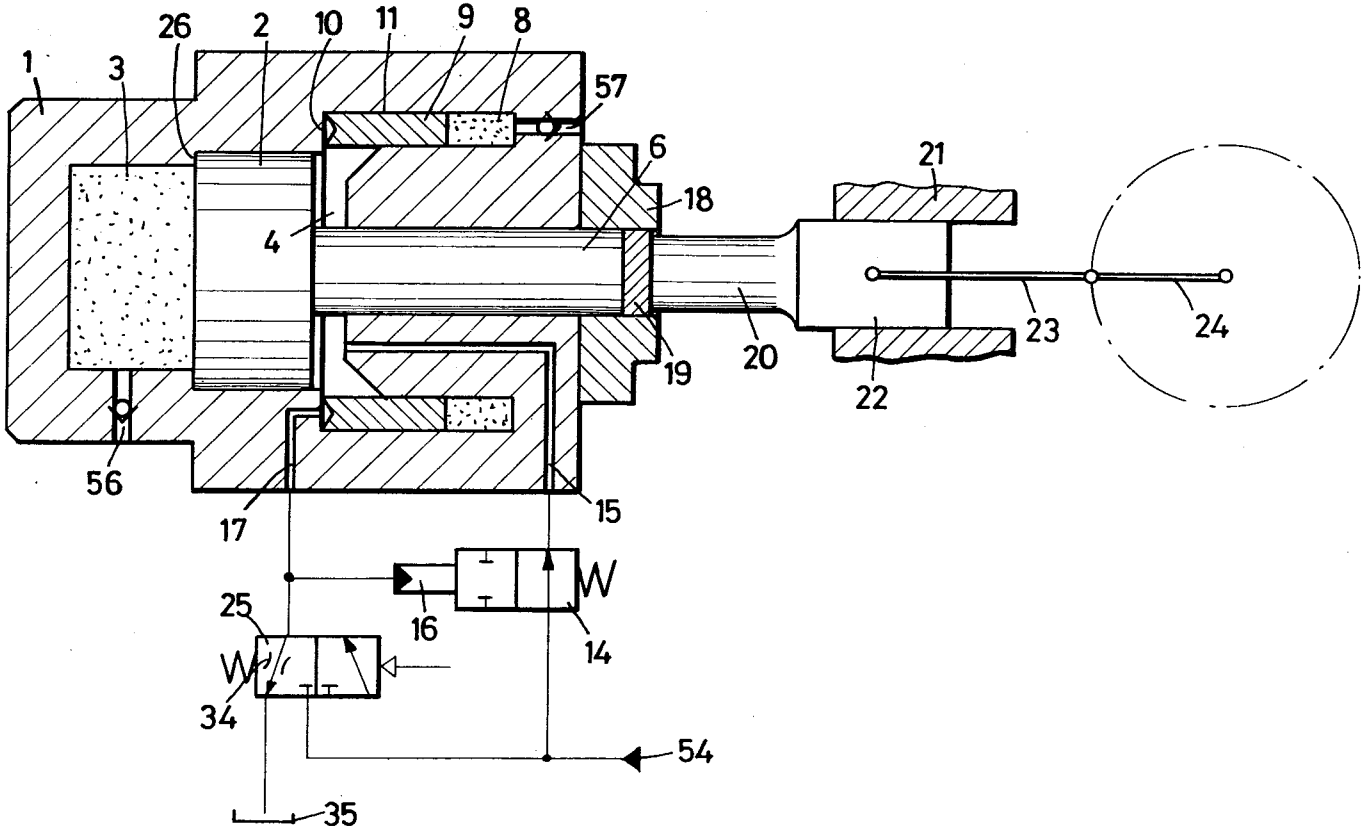
FIG. 2 is an axial cross-section through a second embodiment, in which a counter-punch operated by a crank drive is arranged opposite the piston rod of the working piston.

The various elements shown in FIGS. 2 - 6 which perform the same function as the elements described above in connection with FIG. 1 are referred with the same reference numeral as in FIG. 1. The embodiment shown in FIG. 2 is used as a coining press, in which the piston rod 6 is formed as a working punch. An end portion of the piston rod 6 is moved into a matrix 18, in which the workpiece 19 is arranged, to act on one face of this workpiece, whereas the other face thereof is engaged by a counter-punch 20 having a crosshead 22 guided in a guide 21 for movement in longitudinal direction and driven by a crank drive comprising a connecting rod 23 and a crank 24. This arrangement has the advantage that the return stroke of the working piston 2 and the piston rod 6 connected thereto can be produced by the crank drive, whereas the working stroke of the working piston and the piston rod is produced by the fluid arrangement.

The control piston 9 in this embodiment is constructed as an annular piston having an outer diameter greater than that of the working piston 2. The annular control piston 9 is coaxially arranged with respect to the working piston 2 in an annular space 11, which again communicates with the compartment 4 of the main cylinder 1 when the control piston 9 is moved from the position shown in FIG. 2 towards the right, as viewed in FIG. 2. The control cylinder 8 is again filled with a gas under low pressure for biasing the control piston 9 towards the left, as viewed in FIG. 2, so that its left end face may engage the sealing face 10. Instead of a gas under low pressure, a coil compression spring may also be arranged in the space 8 to bias the control piston 9 to the position shown in FIG. 2.

Control of the movement of the control piston 9 is in this embodiment produced by a two-way valve 25 which can be moved from the position shown in FIG. 2, in which the left end face of the control piston 9, as viewed in FIG. 2, is relieved of fluid pressure by the passage 17 which, in the shown position of the valve 25, is connected over a throttle 34 to a tank 35, whereas if the valve 25 is moved by an impulse, as indicated by the arrow, acting on the right end face of the valve to its other position, the passage 17 is connected to a source of fluid pressure 54, so that the control piston 9 is instantaneously moved towards the right, as viewed in FIG. 4, whereby an instantaneous relief of the fluid pressure in the compartment 4 of the main cylinder 1 is obtained, in the manner as described in connection with FIG. 1. The return stroke of the working piston 2 in the arrangement shown in FIG. 2 is limited by engagement of the working piston with an abutment 26 formed in the main cylinder 1.

The operation of the embodiment shown in FIG. 2 differs from the above-described embodiment, as shown in FIG. 1, only in that the movement of the control piston 9 away from its sealing position is not produced by increasing the gas pressure in the compartment 3, but by feeding pressure fluid directly against the end face of the control piston 9 which faces the sealing face 10. The impulse to be imparted to the auxiliary valve 25, to move the same from the position shown to the other position thereof, may be applied in the embodiment shown in FIG. 2 by the crank drive 23, 24 in the upper dead-center position of the latter, shown in FIG. 2. For this purpose the auxiliary valve 25 may be constructed as a solenoid valve and a switch, not shown in the drawing, of a circuit for energizing the solenoid valve may be closed when the crank drive reaches its upper dead-center position shown in FIG. 2.

Figure 3:
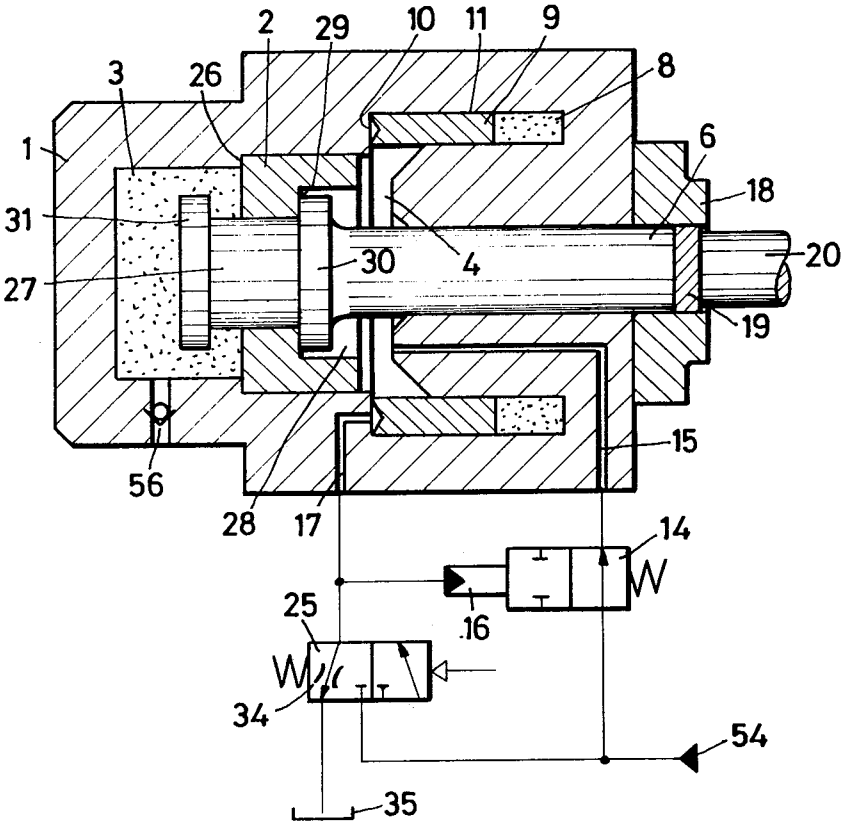
FIG. 3 is an axial cross-section through a third embodiment, similar to FIG. 2, in which the control piston is an annular piston.

The embodiment shown in FIG. 3 substantially corresponds to the embodiment shown in FIG. 2, but is additionally provided with an ejector, for ejecting the workpiece 19 from the matrix 18, after the workpiece has been deformed or coined. For this purpose, the piston rod 6 is provided with an elongation 27, which is fluid-tightly guided in an appropriate opening of the working piston 2. The working piston 2 is provided with a central cutout having an end face 29 against which a flange or abutment 30 of the piston rod 6 abuts during the working stroke of the latter. After the working piston 2 and the piston rod 6 connected thereto has finished its working stroke and after the counter-punch 20 has been withdrawn, the gas pressure in the compartment 3 will act over the elongation 27 of the piston rod to move the formed workpiece 19 out of the matrix 18. The stroke of the piston rod 6 during its ejection movement is limited by a flange 31 provided at the end of the piston rod continuation 27 located in the compartment 3 and adapted to engage the working piston 2. Since the diameter of the elongation 27 is greater than that of the piston rod 6, the latter will be returned together with the working piston to the starting position, shown in FIG. 3, when the annular control piston 9 is moved into the shown position and pressure fluid is fed into the compartment 4.

In order to avoid that the fluid pressure in compartment 4 needs to be considerably greater than the gas pressure in the compartment 3, to thus assure that the working piston 2 as well as the piston rod 6 may be returned to the starting position shown in FIG. 3, the piston rod 6 may be provided with a continuation 32, as shown in FIG. 4, which extends into a cylindrical space 33 coaxially extending from the compartment 3 and into which pressure fluid, preferably a gas under pressure, may be fed. In this case the gas under pressure in the compartment 3 will not act on the piston rod 6 so that the flange 3*a* may be brought into abutment with the face 29 of the working piston 2 already by a relatively low pressure in the compartment 4. In the embodiments shown in FIGS. 2 and 3 the reference numeral 34 designates again a throttle, which in these two embodiments may be located within the three-way valve 25. This throttle 34 will again produce an action on the actuating piston 16 of the control valve 14, in the manner as described in connection with FIG. 1.

Figure 5:
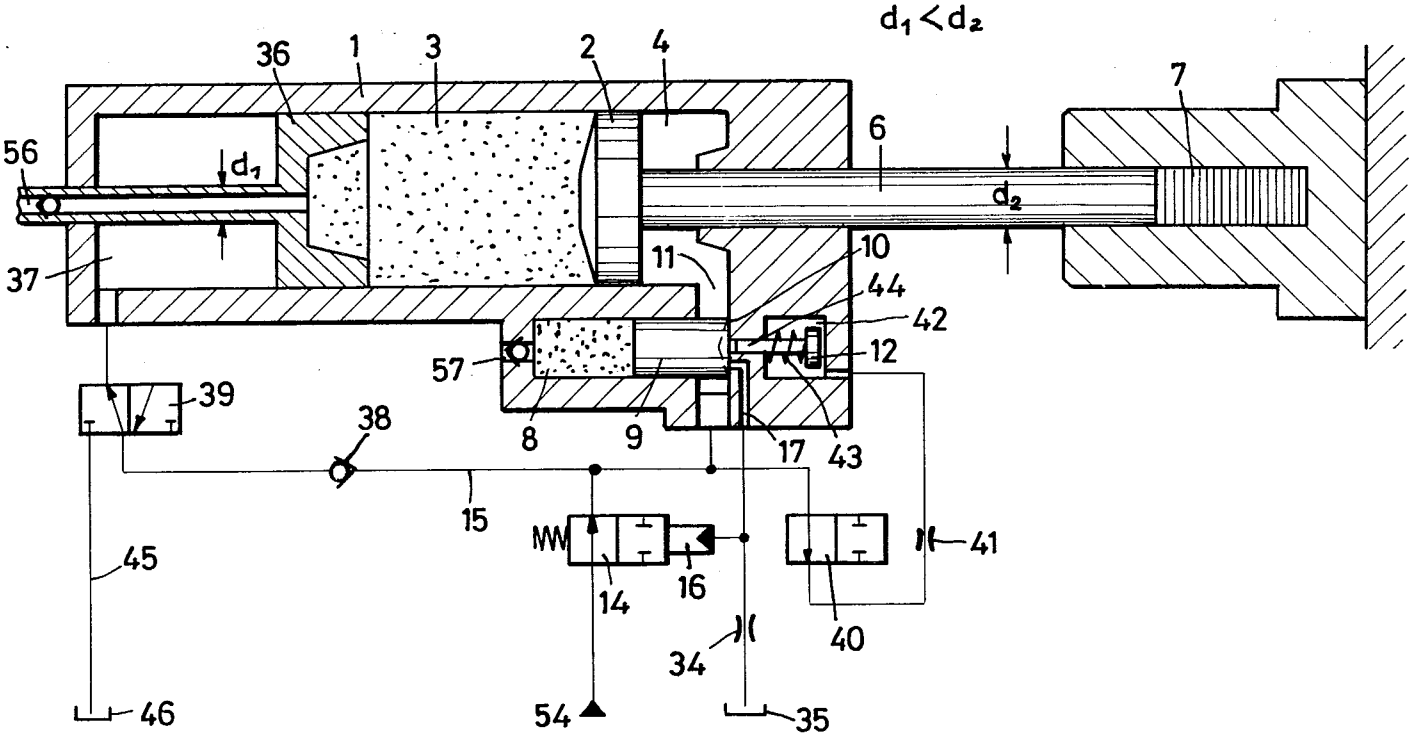
FIG. 5 is an axial cross-section through a fifth embodiment, in which an additional piston is arranged in the main cylinder and in which a gas under pressure is maintained only in the space between the working piston and the additional piston.

In the embodiment shown in FIG. 5 a piston 36 is arranged, in addition to the working piston 2, spaced from the latter and fluid-tightly guided in the main cylinder 1 and in this modification only the space between the additional piston 36 and the working piston 2 is filled with a gas under pressure. The pressure fluid is in this embodiment fed over the control valve 14 into a pressure conduit 15, from which the pressure fluid passes over a non-return valve 38 and a three-way auxiliary valve 39 into the cylinder space 37 located to the right, as viewed in FIG. 5, of the additional piston 36 to act thereby on the additional piston 36. The pressure conduit 15 communicates also with the space 11 and passes from there into the compartment 4 to act on the right face, as viewed in FIG. 5, of the working piston 2. It is pointed out that the space 11 is constructed in such a manner that pressure fluid may pass the control piston 9 in the position of the latter shown in FIG. 5. The acting right face of the working piston 2 is smaller by the cross-section of the piston rod 6 than the acting left face of the additional piston 36, so that the system formed by the additional piston 36, the gas pillow between the latter and the working piston 2 together with the working piston and the piston rod 6 is moved in the direction toward the workpiece 7. This surface difference can be further varied by a piston rod connected to the additional piston 36 and extending in a sealed manner through the left end of the main cylinder 1. The fluid pressure in the conduit 15 passes also through a two-way valve 40, in the position of the latter as shown in FIG. 5, and a throttle 41 into an auxiliary cylinder space 42 in which an auxiliary piston 12 is arranged, movable against the force of a coil compression spring 43, so that the auxiliary piston 12 may act on the control piston 9, the right end of which, as viewed in FIG. 5, engages in the position shown, the sealing face 10. The fluid pressure in the pressure conduit 15 is then raised by a predetermined value sufficient to move the auxiliary piston 12 against the force of the spring 43 and to move thereby the control piston 9 away from the sealing face 10. This will produce, in the manner as pointed out before, an instantaneous reduction of fluid pressure in the compartment 4, which in turn will cause, in the manner as described above, an instantaneous application of a force on the workpiece 7 by the piston rod 6. During movement of the control piston 9 away from the sealing face 10, pressure fluid may flow out from the compartment 4 and the space 11 through the passage 17 and the throttle 34 to the tank 35. The pressure increase upstream of the throttle 35 during the outflow of pressure fluid through the passage 17 will be sufficient in order to actuate the actuating piston 16 of the control valve 14 so that the latter will interrupt flow of pressure fluid to the pressure conduit 15. The connection to the tank 35 will again be interrupted when the force in the cylinder space 8 is sufficient to move the control piston 9 back to its starting position, as shown in FIG. 5, whereafter the above cycle of operation may be repeated. Thereby, the additional piston 36, the gas pillow in the cylinder space 3, and the working piston 2 with its piston rod 6 move intermittently in direction towards the workpiece 7, without interrupting the contact between the free end of the piston rod 6 and the workpiece. The three-way valve 39 can be operated in such a way that the pressure fluid in the cylinder space 37 may flow through a conduit 45 to a tank 46. Thereby it is possible to move the additional piston 36, the gas pillow between the additional piston 36 and the working piston 2, and the latter with its piston rod 6, under the influence of pressure fluid fed into the compartment 4 through the control valve 14, in a direction away from the workpiece 7, whereafter a new sequence of operation may be started. The pressure fluid used in the embodiment of FIG. 5 is preferably, the same as in the embodiments shown in FIGS. 1-4, i.e., a hydraulic pressure fluid.

Figure 6:
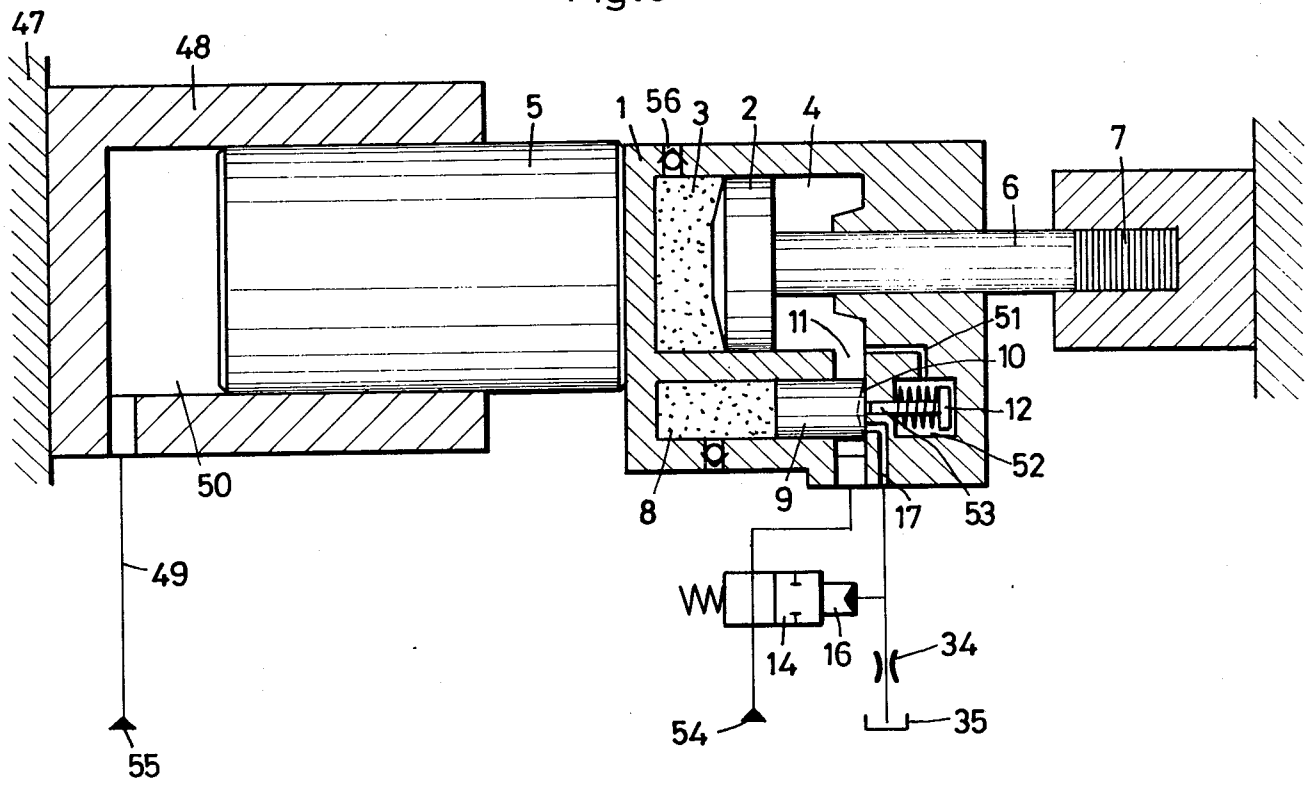
FIG. 6 is an axial cross-section through a sixth embodiment, in which the main cylinder is likewise movable in axial direction towards the workpiece by the piston of a hydraulic press.

The embodiment shown in FIG. 6 is similar to the embodiment shown in FIG. 1. The reference numeral 47 in FIG. 6 schematically indicates the frame of a hydraulic press on which a cylinder 48 of this press is mounted, which has a closed end and an open end. A press piston 5, fluid-tightly guided in the bore of the cylinder 48, projects through the open end of the press cylinder 48 and engages with its right end face, as viewed in FIG. 6, the main cylinder 1, which in this embodiment is likewise movable in axial direction. The cylinder space 50 may be supplied with hydraulic pressure fluid, from a source 55 of such pressure fluid, through a conduit 49. During feeding of pressure fluid into the cylinder space 50, the main cylinder 1 connected to the press piston 5 will be moved in direction towards the workpiece 7. Pressure fluid, preferably hydraulic pressure fluid is fed over the control valve 14 into the space 11 and from there into the compartment 4 of the main cylinder 1 communicating with the space 11, so that such pressure fluid will act on the right face, as viewed in FIG. 2 of the working piston 2. The fluid pressure in the compartment 4 is also transmitted over a passage 51 into the auxiliary cylinder space 52 to act on the auxiliary piston 12, against the action of a compression spring. The auxiliary piston 12 acts on the control piston 9, in the manner as described in connection with FIG. 5 to move the control piston 9 away from the sealing face 10, as soon as a predetermined fluid pressure is reached in the compartment 4. This displacement of the control piston 9 out of the space 11 will produce, in the manner as described before, an instantaneous pressure relieve in the compartment 4 so that the gas pressure in the compartment 3 will produce a corresponding instantaneous pressure application on the workpiece 7 through the working piston 2 and the piston rod 6 connected thereto. During movement of the control piston 9 away from the sealing face 11, pressure fluid will flow out through the passage 17 and the throttle 34 to the tank 35 to produce an action on the actuating piston 16 of the control valve 14, in the manner as described before. The press piston 5, in this embodiment has only the task to move the main cylinder 1 towards the workpiece and to provide a proper abutment for the main cylinder during application of pressure by the piston rod 6 on the workpiece 7.

In all embodiments disclosed, the reference numeral 54 designates a source of pressure fluid, for instance, a hydraulic gear pump, an axial piston pump or a rotary vane pump. The source of pressure fluid 55 shown in the embodiment of FIG. 6 may be similar than that of the source of pressure fluid 54. The reference numerals 56 and 57 respectively indicate channels for feeding gas under corresponding pressure into the compartment 3, respectively, into the control cylinder space 8. Nonreturn valves, schematically shown in the various Figures, are arranged in the channels 56 and 57.

In will be understood that each of the elements described above, or two or more together, may also find a useful application in other types of apparatus for producing an instantaneous pressure on a workpiece, differing from the types described above.

While the invention has been illustrated and described as embodied in an apparatus for producing an instantaneous pressure on a workpiece in which a gas under pressure acts continuously on one side of a working piston while a hydraulic pressure acts on the other side of the piston, which can be instantaneously relieved by moving a control piston quickly out of a space which communicates with the compartment of the main cylinder in which the hydraulic fluid pressure is maintained, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for producing an instantaneous pressure on a workpiece, comprising a main cylinder having a pair of opposite ends; a working piston axially movable in said main cylinder between a working stroke and a return stroke and dividing the main cylinder into two compartments; a piston rod projecting through one of the compartments and one of the ends of the main cylinder to the outside of the latter and engaging with the free end thereof a workpiece; a gas under pressure in the other compartment and acting on one side of the working piston tending thereby to move said working piston along its working stroke; means including a control valve for feeding a pressure fluid into said one compartment to act on the other side of said working piston; means forming an enclosed space communicating with said one compartment so as to be filled with said pressure fluid; a control piston movable from a first position extending into said space to a second position withdrawn out of said space, one end face of the control piston being, in said first position, free of pressure, and pressure means acting on the other face of the control piston for biasing the same to said first position, said control piston having a volume to produce during its movement to said second position an instantaneous relief of the pressure of the pressure fluid acting on the other side of said working piston so that the gas pressure acting on the one side of the working piston will produce a corresponding instantaneous pressure by the piston rod on the workpiece; and means for moving said control piston from said first to said second position thereof.

2. Apparatus as defined in claim 1, wherein said pressure fluid is a hydraulic fluid.

3. Apparatus as defined in claim 1, wherein said free end of said piston rod is constructed as a forging tool.

4. Apparatus as defined in claim 1, wherein said free end of said piston rod forms part of an extrusion press.

5. Apparatus as defined in claim 1, and including a control cylinder in which said control piston is closely guided movable between said positions thereof to extend in said first position with one end portion into said space, a sealing face partly defining said space, passage means communicating at one end at the sealing face with said space, said one end of said control piston engaging in said first position said sealing face to close said passage means.

6. Apparatus as defined in claim 5, wherein said control piston is an annular piston arranged coaxial with a working station.

7. Apparatus as defined in claim 6, wherein the outer diameter of said control piston is greater than that of said working piston, and an annular abutment face in said main cylinder against which said one end of said control piston abuts in said first position.

8. Apparatus as defined in claim 5, wherein said means for moving said control piston from said first to said second position comprises an auxiliary cylinder communicating at one end with said other compartment, a small diameter auxiliary piston reciprocably guided in said auxiliary cylinder and connected to said one end of the control piston for moving the latter from said first to said second position upon increase of the gas pressure in said other compartment.

9. Apparatus as defined in claim 8, including means for increasing the gas pressure in said other compartment comprises means for moving said main cylinder towards the workpiece while said free end of said piston rod engages the workpiece.

10. Apparatus as defined in claim 9, wherein said means for moving said main cylinder comprises a piston of a hydraulic press.

11. Apparatus as defined in claim 5, wherein said means for moving said control piston from said first to said second position comprises an auxiliary valve movable by an impulse between a first position connecting said passage means to atmospheric pressure and a second position connecting said passage means to a source of pressure fluid.

12. Apparatus as defined in claim 11, and including a counter-punch arranged spaced from said free end of said piston rod coaxially therewith and a crank drive for moving said counter-punch towards said piston rod, the workpiece being located between said free end of said piston rod and a corresponding end of said counter-punch, and means for imparting said impulse to said auxiliary valve when said crank drive reaches the region of its upper dead-center position.

13. Apparatus as defined in claim 12, and including a matrix enclosing the space between the free end of said piston and that of said counter-punch.

14. Apparatus as defined in claim 13, wherein said piston rod passes axially movable and in a sealed manner through said working piston into said other compartment to be subjected at an end face thereof opposite said free end to the gas pressure in said other compartment, and including abutment means on said piston rod against which said other side of said working piston abuts during movement of the latter along its working stroke, said piston rod moving in one direction relative to said working piston to move the workpiece out of a matrix when said crank drive moves towards its lower dead-center position, and means for limiting movement of said piston rod in said one direction relative to said working piston.

15. Apparatus as defined in claim 14, and including a cylindrical space coaxially extending from said other compartment, said piston rod extending in a sealed manner and axially movable into said cylindrical space, and means for feeding a pressure fluid into said cylindrical space for moving said piston rod in said one direction relative to said working piston.

16. Apparatus as defined in claim 5, and including said control valve movable between an active position connecting a source of pressure fluid with said one compartment and an inactive position preventing flow of pressure fluid into said one compartment, said control valve comprises an actuating piston for moving said control valve to said inactive position when impinged by said pressure fluid and said actuating piston being impinged by said pressure fluid through said passage means upon movement of said control piston from said first to said second position.

17. Apparatus as defined in claim 16, and including an additional piston in said other compartment spaced from said one side of said working piston, and wherein only the space in said other compartment between said additional piston and said working piston is filled with said gas under pressure, and wherein said means for moving said control piston from said first to said second position comprise an auxiliary cylinder and an auxiliary small diameter piston connected to said control piston, and means for feeding said pressure fluid into said auxiliary cylinder and into the space of said other compartment between said additional piston and said other end of said main cylinder.

18. Apparatus as defined in claim 16, wherein said means for moving said control piston from said first to said second position comprise an auxiliary cylinder, an auxiliary piston reciprocably guided in said auxiliary cylinder and engaging said one end of said control piston for moving the latter from said first to said second position when the fluid pressure in said one compartment reaches a predetermined pressure.

19. Apparatus as defined in claim 18, wherein said main cylinder is movable in axial direction and including means for moving said main cylinder in axial direction towards the workpiece.

20. Apparatus as defined in claim 19, wherein said means for moving said main cylinder in axial direction towards the workpiece comprises a press cylinder coaxially arranged with said main cylinder and having a closed and an open end, a piston reciprocably guided in said press cylinder and projecting with one end portion thereof through said open end into engagement with said main cylinder, and means for feeding a pressure fluid into the space between said closed end of said press cylinder and the other end of the piston therein.

* * * * *